US006255044B1

(12) United States Patent
Levy et al.

(10) Patent No.: US 6,255,044 B1
(45) **Date of Patent: *Jul. 3, 2001**

(54) SILVER HALIDE ELEMENTS THAT PRODUCE SHARP IMAGES WITHOUT FIXING AND PROCESSES FOR THEIR USE

(75) Inventors: David H. Levy, Rochester; John Gasper, Hilton, both of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/010,055

(22) Filed: Jan. 21, 1998

(51) Int. Cl.[7] ..... G03C 1/735
(52) U.S. Cl. ..... 430/559; 430/947
(58) Field of Search ..... 430/559, 947, 430/512, 931

(56) References Cited

U.S. PATENT DOCUMENTS

| | | | | |
|---|---|---|---|---|
| 3,989,527 | | 11/1976 | Locker . | |
| 5,658,718 | * | 8/1997 | Camiti et al. | 430/559 |
| 5,695,747 | * | 12/1997 | Forestier et al. | 424/59 |
| 5,780,214 | | 7/1998 | Hagermann et al. | 430/512 |

FOREIGN PATENT DOCUMENTS

| | | |
|---|---|---|
| 3128600 | 6/1982 | (DE) . |
| 19619946 | 11/1997 | (DE) . |
| 504283 | 4/1939 | (GB) . |
| 760775 | 11/1956 | (GB) . |
| 1342687 | 1/1974 | (GB) . |
| 79/01020 | 11/1979 | (WO) . |

* cited by examiner

*Primary Examiner*—Hoa Van Le
(74) *Attorney, Agent, or Firm*—Andrew J. Anderson; Carl O. Thomas

(57) ABSTRACT

A silver halide imaging element is disclosed that is capable of providing a sharp image with silver halide grains still present following imagewise exposure and development. This is achieved by choosing a dispersing medium for the silver halide grains comprised of an organic vehicle and, dispersed therein, titanium dioxide particles having an average size of less than 0.1 micrometer accounting for at least 10 percent by weight of the dispersing medium. The elements are useful for optical printing or scan image retrieval without fixing. The elements can be used for providing black-and-white photographic images, radiographic images or dye images.

17 Claims, No Drawings

SILVER HALIDE ELEMENTS THAT PRODUCE SHARP IMAGES WITHOUT FIXING AND PROCESSES FOR THEIR USE

FIELD OF THE INVENTION

The invention relates to silver halide imaging elements and to processes of utilizing these elements.

BACKGROUND

Silver halide imaging elements contain at least one radiation-sensitive silver halide emulsion layer. The emulsion layer contains, as a minimum, silver halide grains in a dispersing medium, typically an organic vehicle, such as gelatin.

Black-and-white silver halide imaging elements, following imagewise exposure, are developed to produce a silver image. Silver halide grains that are not converted to silver in the development process are subsequently removed by fixing.

Color (most typically multicolor) silver halide imaging elements, following imagewise exposure, are developed to produce one or more dye images. In the most common imaging route reduction of silver halide to silver (development) oxidizes a color developing agent which in turn reacts with a dye-forming coupler to produce a dye image. The silver that is produced is an unwanted by-product that is reconverted to silver halide by bleaching. All silver halide is removed from the element by fixing.

Environmental concerns have led to a thorough investigation of the processing of silver halide imaging elements. As most commonly practiced element processing includes development in an aqueous developer solution (or activator solution, when the developing agent is incorporated in the element), immersion in a stop bath which adjusts pH to arrest development, fixing to remove silver halide remaining following development, and rinsing. In color photography developed silver is additionally reconverted to silver halide, which is accomplished using a separate bleaching solution or integrated with fixing by using a bleach-fix (i.e., blix) solution.

At one extreme has been the integration of all processing components into a silver halide imaging element and employing heat to activate processing. Although this eliminates all of the aqueous solutions associated with wet processing, the resulting elements are markedly inferior in their imaging capabilities. This has limited their use to specialized applications where the simplicity of dry processing outweighs overall imaging performance.

Much more effort has gone into examining each of the aqueous processing solutions commonly used and modifying their components to reduce environmental objections. Substantial progress has been realized in providing more environmentally favorable developing solutions, but fixing solutions, despite improvements have remained the primary focus of environmental objections.

The need for fixing a silver halide imaging element following development has been traditionally identified as the need to prevent the silver halide grains remaining after development from printing out (that is, from being reduced to silver). This is seen as objectionably elevated minimum densities.

There is, however, a second reason for fixing out residual silver halide. In an imaging emulsion the silver halide grains have a refractive index much higher than the organic vehicle in which they are dispersed. Silver halide has a refractive index ranging from 2.0 to 2.2, depending upon the specific halide. On the other hand, gelatin, the most commonly employed organic vehicle, has a refractive index of only 1.54. Although individual organic vehicles differ somewhat in their refractive indices, all have refractive indices much nearer to gelatin than to silver halide. Virtually all organic materials have refractive indices less than ±10% of the refractive index of gelatin.

Fuji U.K. Specification 1,342,687 (hereinafter also referred to as Fuji '687) suggested that light scatter by image-forming silver halide grains, typically in the 0.3 to 3.0 $\mu$m size range, can be reduced by blending silver halide grains having sizes (i.e., equivalent circular diameters or ECD's) of less than 0.2 $\mu$m Although reducing scatter during light transmission through a silver halide imaging element after processing increases image sharpness, it must also be kept in mind that light scattering during imagewise exposure of a silver halide imaging element has been sought, since it is known to increase imaging speed. Marriage U.K. Specification 504,283, Yutzy et al U.K. Specification 760,775, and Locker U.S. Pat. No. 3,989,527 each add solid particles to increase light scatter, thereby realizing increased imaging speed. When particles are employed for speed enhancement, relatively small concentrations of the particles are effective. For example, Marriage teaches concentrations ranging from 5 to 40 percent for particles having a refractive index of 2.1 or higher. To be effective in scattering light the sizes of the particles must be within ±0.20 $\mu$m of the wavelength of visible light 400 to 600 nm (0.4 to 0.6 $\mu$m). For example, Locker teaches particle sizes ranging from 0.2 to 0.6 $\mu$m for scattering visible light.

SUMMARY OF THE INVENTION

In one aspect this invention is directed to a silver halide imaging element capable of providing a sharp image with silver halide grains still present following imagewise exposure and development comprised of a film support and, coated on the support, at least one image-forming emulsion layer containing radiation-sensitive silver halide grains and a dispersing medium, wherein the dispersing medium is comprised of an organic vehicle and, dispersed therein, titanium dioxide particles having an average size of less than 0.1 micrometer accounting for at least 10 percent by weight of the dispersing medium.

In another aspect this invention is directed to method of obtaining and utilizing an image comprising (1) imagewise exposing an element according to the invention, (2) developing the silver halide grains as a function of imagewise exposure to produce a visible image, (3) without removing silver halide remaining after step (2) from the element, using the visible image to modulate light directed to the emulsion layer, and (4) recording the image pattern of light passing through the element.

Measurable reductions in light scattering are realized with as little as 10% by weight very fine (<0.1 $\mu$m) titanium dioxide particles. With very fine titanium dioxide particles accounting for ≧40% by weight large enhancements in sharpness are realized. It has been discovered that by employing very fine titanium dioxide particles in the dispersing medium of silver halide emulsions it is possible to eliminate the removal of silver halide during processing while still obtaining high levels of image sharpness. This has the advantage of simplifying processing by entirely eliminating the fixing step and the fixing solution. This reduces the volume of spent processing solutions and eliminates disposal of the most burdensome to manage of the processing solutions in current widespread use, the fixing solutions.

DESCRIPTION OF PREFERRED EMBODIMENTS

In a simple black-and-white film construction an element according to the invention can take the following form:

| FE-I |
|---|
| Surface Overcoat |
| Emulsion Layer |
| Transparent Film Support |
| Antihalation Layer |

The transparent film support can take any convenient conventional form. In its simplest possible form the transparent film support consists of a transparent film chosen to allow direct adhesion of the hydrophilic colloid emulsion layers. More commonly, the transparent film is itself hydrophobic and subbing layers are coated on the film to facilitate adhesion of hydrophilic emulsion layers. Although conventional transparent film supports are sometimes tinted, preferably the film supports in the imaging elements of this invention are both transparent and colorless. Any of the transparent imaging supports can be employed disclosed in *Research Disclosure*, Vol. 389, September 1996, Item 38957, Section XV. Supports, particularly paragraph (2), which describes subbing layers, and paragraph (7), which describes preferred polyester film supports. *Research Disclosure* is published by Kenneth Mason Publications, Ltd., Dudley House, 12 North St., Emsworth, Hampshire P010 7DQ, England.

The emulsion layer contains silver halide grains capable of forming a latent image upon imagewise exposure. To offer practical imaging speeds, the grains typically have an average equivalent circular diameter of at least about 0.3 $\mu$m and are to be distinguished from sometimes employed fine grain populations, such as Lippmann grain populations, incorporated for purposes other than latent image formation.

The silver halide grains contain minor amounts of iodide (typically less than 15 mole percent iodide, based on silver) in a dispersing medium, which taken together form an emulsion. Silver halide grain compositions contemplated include silver bromide, silver iodobromide, silver chlorobromide, silver iodochlorobromide, silver chloroiodobromide, silver chloride, silver iodochloride, silver bromochloride and silver iodobromochloride, where halides are named in order of ascending concentrations. Concentrations of iodide amounting to as little as 0.5 mole percent, based on silver, increase photographic speed. Preferably iodide concentrations are limited to facilitate more rapid processing. In radiographic elements iodide is usually limited to less than 3 (preferably less than 1) mole percent, based on silver, or eliminated entirely from the grains.

In black-and-white photography and radiography the silver halide grain coating coverages are chosen to provide an overall maximum density of at least 3.0 and preferably at least 4.0 following imagewise exposure and processing. Depending upon the specific type of emulsion chosen and the presence or absence of covering power enhancing components, total (i.e., including all emulsion layers) silver coating coverages typically range from 5.0 to 60 (preferably 15 to 50) g/m$^2$, based on silver.

The silver halide emulsions can take the form of either tabular or nontabular grain emulsions, where a tabular grain emulsion is defined as one in which tabular grains account for greater than 50 percent of total grain projected area. Conventional emulsions useful in the imaging elements of the invention include those disclosed in *Research Disclosure*, Item 38957, cited above I. Emulsion grains and their preparation.

Preferred emulsions arc tabular grain emulsions. The following, here incorporated by reference, are representative of conventional tabular grain emulsions of the varied halide compositions set out above:

| | |
|---|---|
| Wilgus et al | U.S. Pat. No. 4,434,226; |
| Kofron et al | U.S. Pat. No. 4,439,520; |
| Solberg et al | U.S. Pat. No. 4,433,048; |
| Wey et al | U.S. Pat. No. 4,414,306; |
| Maskasky | U.S. Pat. No. 4,713,320; |
| Maskasky | U.S. Pat. No. 4,713,323; |
| Piggin et al | U.S. Pat. No. 5,061,609; |
| Piggin et al | U.S. Pat. No. 5,061,616; |
| Saitou et al | U.S. Pat. No. 5,797,354; |
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Maskasky et al | U.S. Pat. No. 5,176,992; |
| Maskasky | U.S. Pat. No. 5,178,997; |
| Maskasky | U.S. Pat. No. 5,178,998; |
| Maskasky | U.S. Pat. No. 5,183,732; |
| Maskasky | U.S. Pat. No. 5,185,239; |
| Tsaur et al | U.S. Pat. No. 5,210,013; |
| Tsaur et al | U.S. Pat. No. 5,221,602; |
| Tsaur et al | U.S. Pat. No. 5,252,453; |
| Maskasky | U.S. Pat. No. 5,264,337; |
| Maskasky | U.S. Pat. No. 5,292,632; |
| House et al | U.S. Pat. No. 5,320,938; |
| Maskasky | U.S. Pat. No. 5,399,478; |
| Maskasky | U.S. Pat. No. 5,411,852; |
| Fenton et al | U.S. Pat. No. 5,476,760. |

A large number of advantages, including superior covering power (Dmax÷silver coating coverage), increased image sharpness, and higher speeds in relation to granularity (image noise), have been attributed to the presence of tabular grains. It is therefore preferred to employ tabular grain emulsions in which tabular grains account for at least 75 (and optimally at least 90) percent of total grain projected area. Tabular grain emulsions have been reported in which substantially all (>98% of total grain projected area) of the grains are tabular.

Tabular grain emulsions are known to be useful in mean equivalent circular diameter (ECD) sizes of up to 10 $\mu$m. It is usually preferred that the maximum average ECD of the tabular grains be less than 5.0 $\mu$m.

Limiting the average ECD of the tabular grains and their thickness, reduces the silver content per grain. This allows the number of grains for a given silver coating coverage to be increased, which translates into reduced granularity. It is contemplated to employ tabular grains that exhibit average thicknesses of less than 0.3 $\mu$m and preferably less than 0.2 $\mu$m. Ultrathin (<0.07 $\mu$m in average thickness) tabular grain emulsions are known and can be employed, but, to avoid warm image tones, it is preferred that the tabular grains have an average thickness of at least 0.1 $\mu$m.

The tabular grains preferably exhibit at least an intermediate average aspect ratio (i.e., an average aspect ratio of at least 5). Average aspect ratio (AR) is the quotient of average ECD divided by average tabular grain thickness (t):

$$AR=ECD\div t$$

High (>8) average aspect ratios ranging up to 100 or higher are contemplated. Average aspect ratios are typically less than 70.

The silver halide grains are almost always chemically sensitized. Any convenient conventional chemical sensitization can be employed. Noble metal (e.g., gold) and middle chalcogen (i.e., sulfur, selenium and tellurium) chemical sensitizers can be used individually or in combination. Selected site silver salt epitaxial sensitization as taught by Maskasky U.S. Pat. No. 4,435,501 is also contemplated. Conventional chemical sensitizers are disclosed in *Research Disclosure*, Item 38957, cited above, Section IV. Chemical sensitization.

When the silver halide grains are high bromide (>50 mole percent, based on silver) grains, particularly when significant levels of iodide are also present, the native sensitivity of the grains to blue light can be employed for imaging. For recording exposures outside the spectral region of native sensitivity (e.g., in the green and/or red) spectral sensitizing dye is adsorbed to the silver halide grain surfaces. Sensitizing dyes can also be employed to enhance sensitivity in the blue region of the spectrum. Any convenient conventional spectral sensitizing dye or combination of dyes can be employed. Conventional spectral sensitizers are disclosed in *Research Disclosure*, Item 38957, cited above, Section V. Spectral sensitization and desensitization, A. Sensitizing dyes. Both panchromatic and orthochromatic spectral sensitizations of black-and-white photographic elements is contemplated.

In the simplest possible form, the dispersing medium forming the emulsion layer consists of an organic vehicle and titanium dioxide particles. The organic vehicle includes the peptizer and binder that forms the emulsion layer. Typically the organic vehicle is chosen from among hydrophilic colloids when the use of aqueous processing solutions is contemplated. A general description of vehicles and vehicle extenders and hardeners for the emulsion layer as well as the surface overcoat and antihalation layer is provided by Item 38957, Section II. Gelatin (including gelatin derivatives, such as acetylated gelatin and phthalated gelatin) constitute preferred organic vehicles (both as peptizers and binders) for the processing solution permeable layers of the imaging elements of the invention. The use of cationic starch as peptizers for tabular grain emulsions is taught by Maskasky U.S. Pat. Nos. 5,620,840 and 5,667,955. Treatment of organic vehicles, such as gelatin and starch, with oxidizing agents as well as deionizing treatments have little influence on their refractive indices and accordingly have little or no impact on their utility in the practice of this invention. Both treated and untreated organic vehicles are contemplated for use in the practice of the invention.

Other conventional features of preferred emulsion layers of the imaging elements of the invention are disclosed both in Item 38957, cited above, which is directed to silver halide emulsion technology generally, and in *Research Disclosure*, Vol. 184, August 1979, Item 18431, the disclosure of which is directed specifically to radiographic elements. The emulsion grains can be internally doped as disclosed in Item 38957, Section I, sub-section D, and Item 18431, Section I, sub-section C. The emulsions can contain antifoggants and stabilizers, as disclosed in Item 38957, Section VII, and Item 18431, Section II.

Titanium dioxide (a.k.a., $TiO_2$) particles with mean sizes (ECD's) of less than 0.1 $\mu$m (micrometer) are dispersed along with the silver halide grains in the emulsion layer. Preferably the average size of the titanium dioxide particles is less than 0.07 $\mu$m and most preferably less than 0.05 $\mu$m. Generally the smallest conveniently obtainable sizes of the $TiO_2$ particles are preferred.

It is also preferred that at least 95 percent of the $TiO_2$ particles have an ECD of less than 0.15 $\mu$m. Most preferably at least 95 percent of the $TiO_2$ particles have an ECD of less than 0.10 $\mu$m. Although any $TiO_2$ particle population having a mean ECD of less than 0.1 $\mu$m is useful, minimizing the percent by number of $TiO_2$ particles above the stated sizes minimizes the presence of $TiO_2$ particles that are capable of contributing to light scatter.

The $TiO_2$ particles can be either in their rutile or anatase forms. The particles exhibit a refractive index (R.I.) of from 2.5 to 2.9, depending upon the form in which they are employed.

It is contemplated to blend the $TiO_2$ particles (R.I. 2.5–2.9) with the organic vehicle (R.I. within ±10% of the 1.54 R.I. for gelatin) to create a composite refractive index for the dispersing medium (including the particles) that more closely matches that of the silver halide (R.I. 2.0–2.2).

Concentrations of the $TiO_2$ particles in the dispersing medium as low as 10 percent by weight, based on the total weight of the dispersing medium (including the $TiO_2$ particles) forming the emulsion layer are contemplated. The $TiO_2$ particles preferably account for at least 40 percent of the total weight of the dispersing medium (including the $TiO_2$ particles) forming the emulsion layer. Most preferably, the $TiO_2$ particles are provided in a concentration of at least 50 percent by weight based on the total weight of the dispersing medium. Very high concentrations of $TiO_2$ particles, up to 95 percent by weight, based on total weight, are feasible. Since the optimum loading of $TiO_2$ particles is that which provides a composite refractive index that approximates that of the silver halide grains rather than simply the highest attainable composite refractive index, it is preferred to limit the maximum concentration of the $TiO_2$ particles to 90 percent or less of the total weight of the dispersing medium. In all but the very simplest imaging element constructions the presence of organic addenda (counted as part of the dispersing medium) limit the maximum amounts of $TiO_2$ particles that can be loaded into the emulsion layers.

To be effective in reducing light scatter it is, of course, essential that the $TiO_2$ particles be located in the same layer as the silver halide latent image forming grains. Whereas $TiO_2$ particles have been from time to time suggested for incorporation in photographic elements in other locations (e.g., surface coats or undercoats) to perform other functions, most typically light scattering, $TiO_2$ particles selected as described above are ineffective to increase the image sharpness of the imaging elements of the invention as herein contemplated when located in layers other than the latent image forming emulsion layers.

One important point to note is that the percentage of the dispersing medium made up of $TiO_2$ particles is independent of the number or weight of silver halide grains in a layer. If, for example, the dispersing medium requires $TiO_2$ particles in a concentration of 80 percent of total weight to match the refractive index of the silver halide grains present, this is true whether the coating coverage of silver halide in the layer is a minimum 5 g/m$^2$ or a maximum 60 g/m$^2$.

Any conventional weight ratio of silver halide (based on silver) to dispersing medium in a silver halide emulsion layer can be employed. Typically the weight ratio of silver halide (based on silver) to dispersing medium is in the range of from about 1:2 to 2:1. In the practice of this invention preferred weight ratios of silver halide (based on silver) to dispersing medium are in the range of from 1:1 (most preferably 1.5:1) to 2:1.

The surface overcoat in FE-I is an optional, but preferred feature. In its simplest form the surface overcoat can consist of an organic vehicle (most commonly gelatin) of the type described above in connection with the emulsion layer. Surface overcoats are provided to perform two basic functions: First, to provide a layer between the emulsion layer and the surface of the element for physical protection of the emulsion layer during handling and processing. Second, to provide a convenient location for the placement of addenda, particularly those that are intended to modify the physical properties of the imaging element. The surface overcoat can include the features disclosed by *Research Disclosure*, Item 18431, cited above, IV. Overcoat Layers, and can also include addenda (including coating aids, plasticizers and lubricants, antistats and matting agents) disclosed by *Research Disclosure*, Item 38957, IX. Coating physical property modifying addenda. It is also common practice to divide the surface overcoat into a surface layer and an interlayer. This allows addenda in the surface overcoat to be distributed between the surface layer and interlayer in any convenient, advantageous manner. For example, addenda in the surface overcoat can be physically separated from the emulsion layer, if desired, when an interlayer is present.

The antihalation layer is also an optional, but preferred component of FE-I. The antihalation layer contains in its simplest form an organic vehicle and a processing solution decolorizable dye. The same organic vehicles suitable for use in the emulsion layer and surface overcoat are useful in the antihalation layer. Any convenient conventional processing solution decolorizable dye or combination of dyes can be employed in the antihalation layer. Suitable antihalation dyes are disclosed in *Research Disclosure*, Item 38957, VIII. Absorbing and scattering materials, B. Absorbing materials.

The antihalation layer increases image sharpness by absorbing light that would otherwise be reflected back to the emulsion layer during imagewise exposure, thereby reducing image sharpness. To perform its antihalation function the layer can be coated on the back side of the transparent film support, as shown, or interposed between the emulsion layer and the film support.

A second function that the antihalation layer can be called upon to perform when the imaging element takes the form of a flat film sheet, is that of an anticurl layer. It balances the physical forces exerted on the film support by the emulsion layer and surface overcoat to allow the film to lie flat. To perform this function the antihalation layer must, of course, be coated on the side of the film support opposite from the emulsion and overcoat layers.

If desired, a surface overcoat as described above can be coated over the antihalation layer.

Imaging element FE-I constructed as described above is well suited for black-and-white photography. During imagewise exposure the surface overcoat is transparent. Light is transmitted without scattering to the emulsion layer.

In the emulsion layer a portion of the light used for exposure is absorbed by the silver halide grains. Whereas conventionally a significant amount of light incident during exposure is scattered within the emulsion layer, the presence of a dispersing medium having a composite refractive index more closely matching that of the silver halide grains, as described above, reduces light scatter during imagewise exposure. Light passing through the emulsion layer also passes through the transparent film support and is absorbed within the antihalation layer.

Following imagewise exposure the imaging element FE-I undergoes conventional black-and-white processing to produce a developed silver image, except that the step of removing silver halide from the element, the fixing step, is omitted. The retention of silver halide in the emulsion layer following processing leaves the imaging element susceptible to fogging (Dmin elevation), but this can be avoided merely by protecting the film from light exposure. For example, whereas conventional black-and-white imaging elements are handled and allowed to stand in ambient room light after processing, the imaging elements of the invention are contemplated to be protected from room light. For example, the film can be processed entirely and subsequently handled in the dark or under safe light conditions. The conventional black-and-white processing steps contemplated, including development, arresting development using a stop bath, and rinsing, are illustrated by *Research Disclosure*, Item 38957, XVII. Chemical development systems, A. Non-specific processing features; XIX. Development; and XX. Desilvering, washing, rinsing and stabilizing, D. Washing, rinsing and stabilizing.

Following processing image information is retrieved from the imaging element by passing light through the element. In the absence of $TiO_2$ particles in the dispersing medium, the large refractive index mismatch between the organic vehicle and the silver halide grains produces significant objectionable light scattering. By lowering the difference between the refractive index of the silver halide and the composite refractive index of the dispersing medium, the degree of light scattering is reduced. When the silver halide and composite refractive indices are exactly matched, the interface between the silver halide and dispersing medium in which they are dispersed ceases to be a source of light scatter and hence image unsharpness.

The silver image in the imaging element can be used, for example, to modulate light as it passes through the imaging element prior to exposing a black-and-white print element. The print element can take any convenient conventional form. The most commonly employed print elements contain one or more silver halide emulsion layers coated on a reflective (usually white) support.

An alternative technique for retrieving the image information in the imaging element of the invention is to scan the film using a light source, such as a photodiode or laser, and a photosensor. In a simple approach a laser beam is moved across the film in a sequence of steps with the step location of the laser beam and the light-receiving photosensor being recorded. This breaks the image down into a series of location (pixel) densities that can be digitally recorded in a computer. The computer stored image information can be used to create a viewable image by guiding a laser during subsequent pixel-by-pixel exposure of a print element. Alternatively a diffuse light source can be used to illuminate the film element and a focusing light collector can be used for scanning.

The black-and-white imaging element FE-I can be used to record either photographic or radiographic images. In the latter case, an intensifying screen is placed in contact with the surface layer during imagewise exposure. An image pattern of X-radiation incident upon the intensifying screen produces an image pattern of light that exposes the imaging element. The image pattern of X-radiation is created by the passage of X-radiation through a subject (e.g., person or object) sought to be examined. Conventional intensifying screens and their construction are illustrated by *Research Disclosure*, Item 18431, cited above, IX. X-Ray Screens/Phosphors. Preferred intensifying screen constructions are disclosed by Bunch et al U.S. Pat. No. 5,021,327 and Dickerson et al U.S. Pat. Nos. 4,994,355 and 4,997,750, the disclosures of which are here incorporated by reference.

To minimize the X-radiation required for imaging it is common practice to employ dual-coated radiographic imaging elements. That is, one or more emulsion layers are coated on both sides of a transparent film support. A typical dual-coated radiographic imaging element is constructed as follows:

| RE-II |
|---|
| Surface Overcoat |
| Emulsion Layer |
| Particulate Dye Layer |
| Transparent Film Support |
| Particulate Dye Layer |
| Emulsion Layer |
| Surface Overcoat |

The transparent film support, surface overcoat and emulsion layer can be identical to corresponding elements in FE-I, described above. Conventional radiographic film supports, including blue tinting dyes, are described in *Research Disclosure*, Item 18431, cited above, XII. Film Supports. Whereas conventional radiographic films are usually intended to be viewed against a diffuse light source (i.e., a light box), and employ blue tinted supports to reduce visual fatigue, there is no reason to employ a blue tinted support in the radiographic elements of the invention, since the films are not intended to be used for direct viewing. Further, blue tinting offers the disadvantage of raising minimum density slightly. The radiographic imaging elements of the invention preferably contain colorless transparent film supports.

The function of the particulate dye layers is to reduce crossover during imagewise exposure. In a dual-coated element, such as RE-II, an intensifying screen is placed in contact with each surface overcoat. During exposure a portion of the imagewise distributed X-radiation strikes a first (front) intensifying screen and is absorbed. The remainder of the X-radiation penetrates the radiographic imaging element and a portion of this X-radiation is absorbed by the second (back) intensifying screen. In response to X-radiation each intensifying screen emits light in an image pattern corresponding to the image pattern of X-radiation. When emitted light from an intensifying screen exposes only the emulsion layer on the same side of the support, a sharp image can be obtained, but when a significant portion of the emitted light penetrates the transparent support and exposes an emulsion layer on the opposite side of the support, image sharpness is significantly degraded. This problem is referred to as crossover. A variety of techniques have been proposed for crossover control, as illustrated by *Research Disclosure*, Item 1843 1, V. Cross-Over Exposure Control.

The use of spectrally sensitized tabular grains in the emulsion layers in itself reduces crossover to tolerable levels, as illustrated by Abbott et al U.S. Pat. Nos. 4,425,425 and 4,425,426, the disclosures of which are here incorporated by reference. Crossover levels can be further reduced or, for all practical purposes eliminated, by the use of processing solution decolorizable particulate dyes in an undercoat, as illustrated by the particulate dye layers of RE-II. The particulate dye is dispersed in a processing solution permeable dispersing medium, such as an organic vehicle of the same type described above in connection with the emulsion layers and surface overcoats. The use of particulate dye layers to reduce crossover is disclosed by Dickerson et al U.S. Pat. Nos. 4,803,150, 4,900,652, 4,994, 355, and 4,997,750, the disclosures of which are here incorporated by reference.

In radiographic imaging considerable importance is placed on minimizing the required processing time. The reason for this is that a patient is asked to wait following X-ray exposure to determine if an acceptable image has been obtained. The need for rapid processing is compounded by the current practice of concentrating X-ray imaging in high imaging volume facilities, such as radiology clinics. A conventional rapid access processing cycle useful with Kodak X-Omat™ rapid access processor is illustrated by the following:

| | |
|---|---|
| Development | 24 seconds at 40° C. |
| Fixing | 20 seconds at 40° C. |
| Washing | 10 seconds at 40° C. |
| Drying | 20 seconds at 65° C. |

It is apparent that the fixing step accounts for nearly 30 percent of the time total above. Eliminating the fixing step, the time it consumes, and the fixing solution, offers significant advantages. Recently rapid access processing cycles have been introduced in radiography that reduce the processing cycle to less than 45 seconds and, in some instances, less than 30 seconds. All of these process cycles, however, continue to include the fixing step in an approximately similar time proportion to the remainder of the rapid access processor. It is therefore apparent that the present invention allows a significant and long sought advance in rapid access processing.

Retrieval of the image information from RE-II following processing can be conducted as described above in connection with FE-I.

Instead of constructing FE-I with a transparent film support, as described, the advantages in image sharpness can be realized to an even greater degree when a conventional white, reflective support is substituted. During imagewise exposure and during scanning, light passes through the emulsion layer and is reflected by the support. The reflected light then passes through the emulsion layer a second time. Thus, a light scattering emulsion layer has twice the opportunity to scatter light when coated on a white, reflective support as compared to a transparent film support. When the light scattering properties of an emulsion layer are reduced or eliminated, as contemplated by this invention, an element containing the emulsion layer coated on a white, reflective support makes a very significant contribution to image sharpness.

The preceding discussion has been directed to black-and-white imaging elements (of which radiographic elements are a specialized sub-set) that produce silver images. The invention is equally applicable to imaging elements that produce dye images. For example, FE-I can be used to form dye images merely by employing a color developing agent in a developer solution containing soluble dye-forming couplers, such as currently commercially done in Kodachrome™ processing using the Kodachrome™ K-14 process. A more general description is provided by Mannes et al U.S. Pat. No. 2,252,718, Schwan et al U.S. Pat. No. 2,950,970, and Pilato et al U.S. Pat. No. 3,547,650, the disclosures of which are here incorporated by reference.

Of course, when a dye image is formed in FE-I, the silver image in most instances becomes an unwanted by-product of dye image formation. By bleaching, the silver image can be reconverted to silver halide. Any conventional silver image bleaching step can be employed, such as those illustrated by *Research Disclosure*, Item 38957, cited above, XX. Desilvering, washing, rinsing and stabilizing, A. Bleaching.

To recreate the natural colors of a photographic subject, imaging elements that form dye images typically contain separate blue, green and red recording emulsion layer units and, to simplify processing a dye image former, usually a image dye-forming coupler, is incorporated in each emulsion layer unit that produces a dye of a different substractive primary hue upon processing. When a photographic film is used to create a multicolor dye image through which a color print element is exposed, each of the film and the color print elements contain separate blue, green and red recording emulsion layer units. The blue recording emulsion layer unit contains a yellow dye-forming coupler, the green emulsion layer unit contains a magenta dye-forming coupler, and the red recording layer unit contains a cyan dye-forming coupler. Also colored couplers are also employed to mask unwanted absorptions by the image dyes produced by coupling.

When a photographic imaging element is scanned and the image is stored in a computer, it is possible to use any combination of dye-forming couplers in the emulsion layer units, provided each emulsion layer unit contains a coupler that forms a dye image of a different subtractive primary hue than the other emulsion layer units. It is also possible to dispense with colored couplers, since color rebalancing can be undertaken by computer manipulation when the image information is in digital form.

In a simple multicolor element construction an imaging element according to the invention can take the following form:

| FE-III |
| --- |
| Surface Overcoat |
| Blue Recording Emulsion Layer Unit |
| Interlayer |
| Green Recording Emulsion Layer Unit |
| Interlayer |
| Red Recording Emulsion Layer Unit |
| Antihalation Layer |
| Support |

The support, the surface overcoat, and the antihalation layer of FE-III can be constructed as previously described. The support can be either a transparent film support or a white, reflective support. When the support is a white, reflective support, it is common practice to omit the antihalation layer. The green and red recording layer units require the respective presence of a green and red absorbing spectral sensitizing dye. As previously pointed out, the blue recording layer unit can incorporate a blue absorbing spectral sensitizing dye or, when the silver halide is chosen to exhibit significant native sensitivity in the blue region of the spectrum, no spectral sensitizing need be present.

For processing convenience it is preferred to incorporate a dye-former in each emulsion layer unit. The most commonly employed dye-formers are image dye-forming couplers. The dye-forming couplers react with oxidized developing agent to produce a subtractive primary dye—that is, a dye that absorbs principally in a single one of the blue, green and red regions of the spectrum. Blue absorbing subtractive primary dyes are yellow; green absorbing subtractive primary dyes are magenta; and red absorbing subtractive primary dyes are cyan.

At least one emulsion layer in one emulsion layer unit contains $TiO_2$ particles in the dispersing medium as previously described. A maximum benefit from a minimum amount of $TiO_2$ particles is realized by selection of the emulsion layer or layers that would otherwise make the greatest contribution to light scattering for $TiO_2$ particle inclusion. At the other extreme, it is contemplated to incorporate $TiO_2$ particles in each of the emulsion layer units. Each dye-forming coupler can be coated in the same layer as the silver halide grains or, preferably, to reduce $TiO_2$ requirements, in an adjacent (usually a contiguous) layer. The dye-forming coupler, even when incorporated in a layer containing latent image forming silver halide grains, is not counted as part of the dispersing medium for purposes of determining the proportion of $TiO_2$ to be incorporated. The reason for this is that the dye-forming couplers are dispersed in the organic vehicle as discrete droplets and remain segregated from the silver halide grains in the organic vehicle, which is typically a hydrophilic colloid, such as gelatin. Although the dye-forming coupler represents a third, discrete phase in an emulsion layer, its presence does not significantly contribute to image unsharpness, since both the coupler and vehicle are organic compounds that do not differ to any large extent in their refractive indices. Typically their refractive index differences or much less than ±10% of the 1.54 refractive index of gelatin, the most commonly employed organic vehicle. Any convenient conventional dye image former can be incorporated in the emulsion layer units. Conventional dye image formers and modifiers are illustrated by *Research Disclosure*, Item 38957, cited above, X. Dye image formers and modifiers and XII. Features applicable only to color negative, the latter particularly disclosing colored (masking) couplers.

The interlayers are provided to reduce or eliminate color contamination attributable to oxidized developing agent wandering between layer units prior to coupling. Oxidized developing agent scavengers (a.k.a., antistain agents), are illustrated by *Research Disclosure*, Item 38957, X. Dye image formers and modifiers, D. Hue modifiers/stabilization, paragraph (2). When the green and/or red recording layer units possess significant native blue sensitivity, it is conventional practice to place a blue absorber (e.g., a yellow dye or Carey Lea silver), illustrated by *Research Disclosure*, Item 38957, VIII. Absorbing and scattering materials, B. Absorbing materials.

Exposure and processing of FE-III can be identical to that of the form of FE-I that produces a dye image. In FE-III three separate dye images are produced, each of which absorbs in a different region of the spectrum. When the support is a transparent film support, the dye image information can be obtained by directing white light to FE-III to transmit a multicolor image to a color print element. Although a conventional color print element can be employed, to maximize the image sharpness obtainable, it is preferred to employ a color print element satisfying the requirements of the invention. For example, a form of FE-III having a transparent film support can be used to expose a form of FE-III that has a white, reflective support. When FE-III contains a white, reflective support, colored (masking) couplers are absent and components are optimized for viewing, as illustrated by *Research Disclosure*, Item 38957, XIII. Features applicable only to color positive, C. Color positives derived from color negatives.

The silver halide emulsions incorporated in the imaging elements of the invention are most advantageously negative-working emulsions, and their processing is most advantageously undertaken to produce a negative image within the imaging element. Reversal processing of the imaging elements of the invention is also feasible, but offers little practical advantage and has the disadvantage of being more complicated. If image reversal is desired, it can be easily accomplished once the image has been converted to a digital form. The use of direct positive emulsions is feasible, and is occasionally used to advantage to form a viewable image without scanning or printing. Although advantages are realized, as described above, by omitting the fixing step, it is appreciated that when conventional processing, including a fixing step, is undertaken the higher index of refraction dispersity medium still contributes significantly to an improvement in image sharpness, since significantly less light scattering still takes place on imagewise exposure to create an image.

EXAMPLES

The invention can be better appreciated by reference to the following specific embodiments.

Emulsion Preparations

Emulsion E-1

A silver iodochloride {100} tabular grain emulsion was prepared in the following manner: A reaction vessel was prepared containing 37.5 g of a lime processed bone gelatin, 0.86 g of Emerest 2648™ antifoamant, 3.15 g of sodium chloride, and 4238 g of distilled water. The reaction vessel temperature was 45° C. A solution containing 4 M silver nitrate and $3.2\times10^{-4}$ g/L mercuric chloride (Solution A) was then added over 0.5 minute at a rate of 45 mL/min. A concurrent flow of 4 M sodium chloride was used to maintain the pCl of the reaction vessel contents at 2.05. Following these additions, 9.75 L of a solution containing 3.3 g sodium chloride and 0.6 g potassium iodide was added, and the contents of the reaction vessel were held for 8 minutes. The following growth stages were then performed by the addition of Solution A as indicated in Table I while the pCl was maintained at a constant value by the simultaneous addition of 4M sodium chloride:

TABLE I

| Time, | Soln A, mL/min | | Temp, ° C. | |
|---|---|---|---|---|
| min | Start | End | Start | End |
| 5 | 15 | 15 | 45 | 45 |
| 15 | 15 | 15 | 45 | 50 |
| 39 | 15 | 42.6 | 50 | 50 |

The reaction vessel contents were then held for 15 minutes, at which time 75 mL of a solution containing 5.62 g potassium iodide were added, followed by an additional 10 minute hold. At this time, Solution A was added to the reaction vessel at a rate of 15 mL/min over a period of 10 minutes, with the pCl maintained at a constant value by concurrent addition of 4M sodium chloride. The resulting emulsion was desalted and concentrated.

The resulting silver iodochloride {100} tabular grain emulsion contained less than 1 M % iodide, based on silver. The mean ECD of the grains was 1.05 μm. Tabular grains accounted for greater than 70 percent of total grain projected area and exhibited an average thickness of 0.13 μm.

Emulsion E-2

A silver iodobromide {111} tabular grain emulsion was prepared in the following manner: A reaction vessel was prepared containing 30 g sodium bromide, 0.63 g of Emerest 2648™ antifoamant, 10 g of a lime processed bone gelatin, and 4946 g of distilled water. The reaction vessel was maintained at 48° C. for the duration of the precipitation. The precipitation reaction was initiated by a simultaneous addition of 2.75 M silver nitrate (Solution B) and 2.87 M sodium bromide, each at a rate of 35 mL/min for 1.3 minutes. At this point the contents of the reaction vessel were held for 1 minute followed by the addition of 379 mL of a 0.475 M solution of ammonium sulfate. After 2 minutes, 200 mL of 1.9M sodium hydroxide were added, followed at 0.5 minute by 200 mL of 1.9 M nitric acid. A solution containing 140 g of gelatin and 1729 g of distilled water was then added to the reaction vessel, followed by a 5 minute hold. At this point, the following growth stages were applied to the reaction vessel by adding Solution B as shown in Table II, with the pBr maintained at 1.57 by the simultaneous addition of a sodium bromide solution:

TABLE II

| Time, | Solution B, mL/min | |
|---|---|---|
| min | Start | End |
| 5 | 15 | 15 |
| 25 | 15 | 40 |
| 31 | 40 | 102 |
| 1.5 | 100 | 100 |

After completion of the growth segments, 71.5 mL of a 2.65 M sodium bromide solution were added to the reaction vessel, followed by the addition of 0.45 mol of silver iodide fine grains. At that point, Solution 13 was added to the reaction vessel at a rate of 50 mL/min for 24 minutes. When the pBr of the reaction vessel reached 2.62, a concurrent flow of sodium bromide solution was used to stabilize the pBr of the reaction vessel to that value. The emulsion was desalted and concentrated, followed by the addition of 200 mL of a solution containing 26.8 g gelatin.

The resulting silver iodobromide {111} tabular grain emulsion contained 3.6 M % iodide, based on silver. The mean ECD of the grains was 0.94 μm. Tabular grains accounted for greater than 70 percent of total grain projected area and exhibited an average thickness of 0.09 μm.

Emulsion E-3

A silver bromide cubo-octahedral grain emulsion was prepared in the following manner: A reaction vessel was prepared containing 14.3 g/L of an oxidized lime processed bone gelatin, 0.36 g/L sodium bromide, and 6.87 L of distilled water. The reaction vessel was maintained at 70° C. for the duration of the precipitation. Silver additions occurred from a solution containing 3.5 M silver nitrate and $2.24\times10^{-4}$ g/L mercuric chloride (Solution C). The reaction was initiated by the addition of solution C over 45 minutes, with a flow rate linearly ramped from 15 to 115 mL/min. The pBr of the reaction vessel was maintained by the simultaneous addition of a sodium bromide solution. At that point, 262 mL of a solution containing 46 g of gelatin was added, followed after 10 minutes by a 30 minute addition of a solution containing 0.5 M sodium bromide and 0.5 M potassium iodide at 29.3 mL/min. At that point Solution C was added at a rate of 111 mL/min for 11.3 minutes. During this process, the pBr of the reaction vessel was allowed to reach 2.74 and then was maintained at this level by the simultaneous addition of a sodium bromide solution. The emulsion was desalted and concentrated.

The resulting silver bromide emulsion contained monodispersed cubo-octahedral grains—that is, grains with six {100} crystal faces and eight {111} crystal faces. The mean ECD of the grains was 0.26 μm.

Emulsion E-4

A silver iodobromide {111} tabular grain emulsion was prepared in the following manner: A solution containing 10 g of a lime processed bone gelatin, 30 g of sodium bromide, 0.65 g of Emerest 2648™ antifoamant, and 4960 g of water was maintained in a vigorously stirred reaction vessel at 48°

C. Nucleation was accomplished by a simultaneous addition for 1.25 minutes of a 2.75 M solution of silver nitrate a 2.87 M solution of sodium bromide both at 35 mL/min.

One minute after nucleation, 373 mL of a solution containing 0.09 mole of ammonium sulfate were added, followed at 1 minute by 76 mL of 2.5 M sodium hydroxide. After an additional 1.5 minutes, 48 mL of 4.0 M nitric acid were added, followed by 1.82 liters of a solution containing 140 g gelatin. The reaction vessel contents were then held for 5 minutes, at which time a 2.75 M solution of silver nitrate was added to the reaction vessel at the rates listed in Table III. During this time, the pBr of the reaction vessel contents was maintained at 1.55 by a simultaneous addition of a solution containing 2.71 M sodium bromide and 0.041 M potassium iodide.

TABLE III

| Segment | Time, min. | $AgNO_3$ Solution, mL/min Start | End |
|---|---|---|---|
| 1 | 3 | 15 | 15 |
| 2 | 25 | 15 | 40 |
| 3 | 31 | 48 | 102 |
| 4 | 1.5 | 100 | 100 |

After growth, 720 mL of a solution containing 195 g sodium bromide were added to the reaction vessel, followed at 2 minutes by the addition of 0.36 mole of preformed silver iodide fine grains. After a two minute hold, a 2.75 M solution of silver nitrate was added to the reactor at 50 mL/min for 24 minutes. During this time, the pBr of the reaction vessel contents was allowed to rise to 2.62 and was maintained at that value by a simultaneous addition of 2.75 M sodium bromide. The resulting emulsion was desalted and concentrated.

The resulting silver iodobromide {111} tabular grain emulsion contained 3.6 M % iodide, based on silver. The mean ECD of the grains was 1.0 μm. Tabular grains accounted for greater than 70 percent of total grain projected area and exhibited an average thickness of 0.09 μm.

Titanium Dioxide Particle Preparations

Dispersion T-1

Titanium dioxide in the amount of 16.8 g obtained commercially as APG-Tioxide™ and 2.1 g of the commercially available dispersant Dispex N-40™ were added to 81.1 g of distilled water. The resulting mixture was homogenized at high power for 5 minutes to yield a dispersion containing single particles (and small agglomerates of particles) with an average particle size of 0.23 μm.

Dispersion T-2

Titanium dioxide in the amount of 8.4 g obtained commercially as TiSorb2™ from Tioxide North America and 1.05 g of Dispex N-40™ were added to a vessel containing 40.6 g of distilled water. Sixty cc of 1.8 mm zirconium oxide beads were added, and the sealed vessel was vibrated on a SWECO™ mill for 4 days to reduce mean particle size.

The resulting dispersion contained $TiO_2$ particles with an average diameter of 0.097 μm, determined by the sizing of particle images of a scanning electron micrograph.

T-3

A reaction vessel was prepared containing 495 g of distilled water at room temperature. With vigorous stirring, a solution containing 250 mL of titanium tetraisopropoxide and 40 mL of isopropanol was added from a dropping funnel at a rate of approximately 25 mL/min. The resulting material was transferred to a metal container, and 2 g of a 25% solution of tetramethylammonium hydroxide in water was added. The mixture was heated to allow evaporation of the isopropanol reaction product, and, upon reaching 100° C., 38.2 g of an 8.6% solution of tetramethylammonium hydroxide in water were added. The mixture was then transferred to an Erlenmeyer flask equipped with a condenser and was refluxed for 404 hours.

The resulting dispersion contained 16.8% $TiO_2$ by weight. The dispersion appeared translucent and exhibited a mean particle size of 0.02 μm.

Black-and-white Imaging Elements

These element series demonstrate selected parameters, described in detail below. All coatings were designed to be equivalent in thickness, thus explaining the higher weight laydown of the $TiO_2$ containing coatings. Scattering measurements were obtained by a spectrophotometer capable of individually measuring the total and diffuse transmissions of a coating sample. The ratio of diffuse light to total light transmitted, labeled here as r, represents the percentage of light passing through a imaging element that is scattered (i.e., collected outside a collection cone formed by a deviation angle θ of 12 degrees from the original direction of light transmission, described in detail by Kofron et al U.S. Pat. No. 4,439,520, the disclosure of which is here incorporated by reference). Lower r values indicate less light scattering. All scattering measurements were taken at a wavelength of 600 nm.

Black-and-white processing was done in a developer of the formulation listed in Table IV. After exposure, strips were dipped in the developer solution at room temperature for 1 minute, followed by a 30 second dip in a conventional stop bath, and a 4 minute wash in water.

TABLE IV

| Component | Wt. % |
|---|---|
| p-N-Methylaminophenol hemisulfate | 0.5 |
| Hydroquinone | 1.0 |
| Sodium sulfate | 7.2 |
| Sodium metaborate | 3.5 |
| Sodium bromide | 0.5 |
| Sodium hydroxide | 0.35 |
| Potassium iodide | $1 \times 10^{-6}$ |
| Water to 1 liter | |

Element Series 1: $TiO_2$ Particle Type

The following elements were prepared to show the specific size range of $TiO_2$ particles that perform satisfactorily in the imaging elements of this invention. All coatings in this series employed lime processed bone gelatin and used emulsion E-1, when an emulsion was present. The coatings were hardened by incorporation of bis(vinylsulfonylmethyl) ether (BVSME) at a level of 1.8% by weight of the coated gelatin.

The light scattering results are summarized in Table V.

TABLE V

| Film Element | Ag $g/m^2$ | $TiO_2$ Type | $TiO_2$ $g/m^2$ | Gelating/ $m^2$ | r % |
|---|---|---|---|---|---|
| 1a | 0 | none | 0 | 2.21 | 1 |
| 1b | 0 | T-3 | 4.87 | 0.61 | 1 |

TABLE V-continued

| Film Element | Ag g/m$^2$ | $TiO_2$ Type | $TiO_2$ g/m$^2$ | Gelating/ m$^2$ | r % |
|---|---|---|---|---|---|
| 1c | 0 | T-2 | 4.87 | 0.61 | 13 |
| 1d | 0 | T-1 | 4.87 | 0.61 | 94 |
| 1e | 1.08 | none | 0 | 2.21 | 59 |
| 1f | 1.08 | T-3 | 4.87 | 0.61 | 14 |
| 1g | 1.08 | T-2 | 4.87 | 0.61 | 57 |
| 1h | 1.08 | T-1 | 4.87 | 0.61 | 94 |

Film elements 1a–1d contained no silver halide and therefore revealed the scatter caused by the $TiO_2$ particles. It is clear that T-3 did not significantly contribute to scatter (only 1% scatter) while T-2 caused low scatter (only 13% scatter). On the other hand, T-1 caused excessive scatter (94%).

When the silver halide emulsion was added (1c–1h), it was observed that the addition of T-3 (1f) and T-2 (1g) offered scatter reduction and the addition of T-1 (1h) actually increased the level of scatter. Thus, the particle size of $TiO_2$ dispersion T-1 (0.23 $\mu$m) was too large to be of use in reducing (and in fact contributed to) light scatter, while sizes associated with T-2 (0.097 $\mu$m) and T-3 (0.02 $\mu$m) were useful in reducing light scatter.

Element Series 2: Emulsion Type

The following elements demonstrate that the scattering reduction accomplished by $TiO_2$ additions (T-3) were obtained with a variety of emulsion types. All coatings in this series contained 1.08 g/m$^2$ of silver, employed a lime processed bone gelatin, and were hardened by incorporating BVSME at a level of 1.8% of the coated weight of gelatin. To obtain photographic data, the coatings were exposed for 10 seconds by a 365 nm light source through a 0–6 log E step wedge, with subsequent processing in the developer as described above, where E represents exposure in lux-seconds.

The results are summarized in Table VI.

TABLE VI

| Element | Emulsion | Gel g/m$^2$ | $TiO_2$ g/m$^2$ | r % | Dmin | Dmax |
|---|---|---|---|---|---|---|
| 3a | E-1 | 2.21 | 0 | 59 | 0.19 | 1.51 |
| 3b | B-1 | 0.61 | 4.87 | 14 | 0.41 | 1.00 |
| 3c | E-2 | 2.21 | 0 | 64 | 0.35 | 1.33 |
| 3d | E-2 | 0.61 | 4.87 | 24 | 0.25 | 2.15 |
| 3e | E-3 | 2.21 | 0 | 71 | 0.44 | 2.40 |
| 3f | E-3 | 0.61 | 4.87 | 22 | 0.29 | 2.13 |

From Table VI, it is apparent that the reduction in scattering caused by incorporating $TiO_2$ was independent of the emulsion used. In addition, all of the emulsions demonstrated a photographic response when $TiO_2$ particles were present.

Element Series 3: Effect of Sensitization:

The following elements were prepared to demonstrate that the scattering reduction accomplished by $TiO_2$ (T-3) additions was compatible with emulsion sensitization. Emulsion E-1 was sensitized by melting 0.6 mol at 40° C. and adding 0.54 mmol of the green absorbing spectral sensitizing dye (SSD-1) anhydro-5-chloro-9-ethyl-5'-phenyl-3'-(3-sulfobutyl)-3-(3-sulfopropyl)-oxacarbocyanine hydroxide, sodium salt, followed by a 20 minute hold. At that point, 1.2 mg of sodium aurous(I)dithiosulfate dihydrate were added, and the mixture was brought to 60° C. for 10 minutes, then returned to room temperature. This sensitized form of Emulsion E-1 is hereinafter referred to as E-1S.

All coatings in this element series employed lime processed bone gelatin and contained 1.08 g/m$^2$ of silver from emulsion E-1S. The gelatin containing layers were hardened by incorporating BVSME at a level of 1.8%, based on the total weight of gelatin.

To obtain photographic data, the elements were exposed for 1 second by a simulated 5500° K. light source through a 0–6 log E step wedge, with subsequent processing in the developer as described above.

The results are summarized in Table VII.

TABLE VII

| Element | Gelatin g/m$^2$ | $TiO_2$ g/m$^2$ | r % | Dmin | Dmax |
|---|---|---|---|---|---|
| 4a | 2.21 | 0 | 54 | 0.36 | 1.95 |
| 4b | 0.61 | 4.87 | 12 | 1.12 | 1.67 |

From Table VII it is apparent that the partial substitution of $TiO_2$ for gelatin resulted in reduced light scattering. Although minimum density was increased by the presence of the $TiO_2$, image discrimination (Dmax−Dmin) remained sufficiently high (0.55) to permit imaging.

Element Series 4: Level Effects

The following examples were prepared to demonstrate that the scattering reductions accomplished by $TiO_2$ (T-3) additions could be obtained with for a wide range of $TiO_2$ levels. All coatings in this element series employ regular lime processed bone gelatin and contain 1.08 g/m$^2$ of silver from emulsion E-1. They were hardened by incorporating BVSME at a level of 1.8% of the total coated gelatin. The percentage of $TiO_2$ refers to the weight percentage of $TiO_2$ relative the entire quantity of binder present.

The results are summarized in Table VIII:

TABLE VIII

| Element | Gel, g/m$^2$ | $TiO_2$, g/m$^2$ | $TiO_2$ % | r % |
|---|---|---|---|---|
| 5a | 2.21 | 0 | 0 | 59 |
| 5b | 2.04 | 0.51 | 20 | 54 |
| 5c | 1.81 | 1.20 | 40 | 51 |
| 5d | 0.61 | 4.87 | 89 | 14 |

From Table VIII it is apparent that incorporating $TiO_2$ at a 20% by weight level reduces scattering by 5 percent. From the overall trend of r values at varied concentrations, it is apparent that measurable reductions in scattering can be realized at $TiO_2$ particle levels as low as 10% by weight. Scattering is reduced by 45 percent at the 89% level of $TiO_2$. This suggests that $TiO_2$ should preferably account for at least 50 percent of the total dispersing medium weight.

Color Imaging Elements

This element series was prepared to demonstrate the compatibility of conventional dye-forming couplers in the $TiO_2$ containing emulsion dispersing media of the imaging elements of the invention.

All of the imaging element emulsion layer coatings employed lime processed bone gelatin at a level of approximately 0.6 g/m$^2$ and $TiO_2$ (T-3) particles at a level of approximately 5 g/m$^2$. The coatings were hardened by the incorporation of BVSME at a level of 1.8% by weight of the coated gelatin.

The emulsions and dye-forming couplers incorporated in the emulsion layers are as indicated in Table IX, wherein C-1 is a cyan (red absorbing) dye-forming coupler having the structure:

C-1

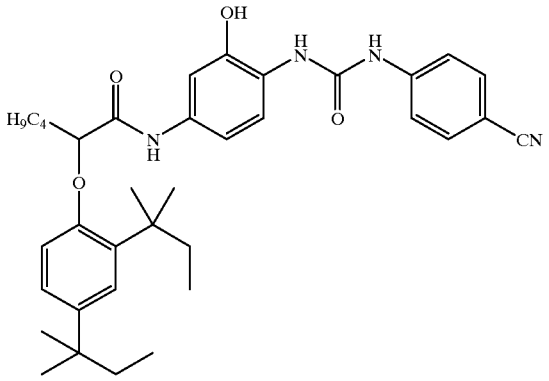

and M-1 is a magenta (green absorbing) dye-forming coupler having the structure:

M-1

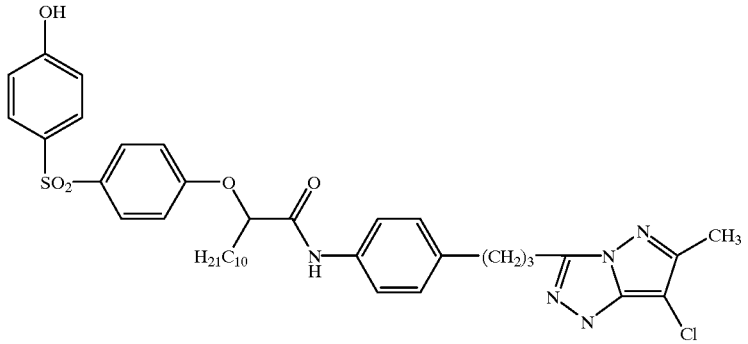

The dye-forming couplers were incorporated in the emulsion layers as modulated phase separation dispersions, thereby achieving a near minimum coupler particle size and avoiding the use of auxiliary solvents (e.g., coupler solvents). Emulsion E-1 was sensitized as described above in the sensitization series. Emulsion E-4 was also sulfur and gold sensitized, but a 6:1 molar ratio of the spectral sensitizing dyes SSD-1 and SSD-2, anhydro-3,9-diethyl-3'-methylsulfonylcarbamoylmethyl-5-phenyloxathiocarbocyanine hydroxide, was employed.

To obtain photographic data, the elements were exposed for 1 second by a simulated 5500° K. light source through a 0–6 log E step wedge. The elements received standard color negative processing using the Kodak Flexicolor C-41™ process, except that the fixing and bleaching steps were omitted. Development was for 3 minutes at 40° C., followed by a 30 second dip in a stop bath and 4 minute wash in water.

The processed imaging elements were analyzed for Status M red (cyan dye) and green (magenta dye) optical densities. Using these optical densities image discrimination ΔD, Dmax−Dmin, was determined. The results are summarized in Table IX:

TABLE IX

| Film Element | Emul. | Ag, g/m$^2$ | Coupler, g/m$^2$ | ΔD Red | ΔD Green |
|---|---|---|---|---|---|
| 6a | E-1 | 1.08 | none | 0.448 | 0.420 |
| 6b | E-1 | 1.08 | C-1, 0.22 | 1.047 | 0.712 |
| 6c | E-4 | 0.81 | M-1, 0.44 | 0.125 | 0.745 |

Film element 6a, lacking a dye-forming coupler, was included to show that in the absence of a dye-forming coupler, development in the color developer yields a neutral image as indicated by the closeness between red and green image discrimination (ΔD) values. When the cyan dye-forming coupler was included, Film element 6b, the cyan image discrimination (ΔD red) increased relative to the magenta (ΔD green) image discrimination, indicative of the formation of cyan dye. Similarly, when the magenta dye-forming coupler was included, Film element 6c, the magenta (ΔD green) image discrimination increased relative to the cyan (ΔD red) image discrimination, indicative of the formation of magenta dye.

The invention has been described in detail with particular reference to preferred embodiments thereof, but it will be understood that variations and modifications can be effected within the spirit and scope of the invention.

What is claimed is:

1. A silver halide imaging element capable of providing a sharp image with silver halide grains still present following imagewise exposure and development comprised of a support and, coated on the support, at least one image-forming emulsion layer containing radiation-sensitive silver halide grains and a dispersing medium,

WHEREIN the dispersing medium is comprised of an organic vehicle and, dispersed therein, titanium dioxide particles having an average size of less than 0.1 micrometer accounting for at least 40 percent by weight of the dispersing medium.

2. A silver halide imaging element according to claim 1 wherein the titanium dioxide particles have an average size of less than 0.07 micrometer.

3. A silver halide imaging element according to claim 2 wherein the titanium dioxide particles have an average size of less than 0.05 micrometer.

4. A silver halide imaging element according to claim 1 wherein at least 95 percent of the titanium dioxide particles are less than 0.15 micrometer in equivalent circular diameter.

5. A silver halide imaging element according to claim 1 wherein at least 95 percent of the titanium dioxide particles are less than 0.10 micrometer in equivalent circular diameter.

6. A silver halide imaging element according to claim 1 wherein the titanium dioxide particles account for from 50 to 90 percent of the total weight of the dispersing medium.

7. A silver halide imaging element according to claim 1 wherein the organic vehicle is comprised of gelatin.

8. A silver halide imaging element according to claim 1 wherein the support is a white, reflective support.

9. A silver halide imaging element according to claim 1 wherein the support is a transparent film support.

10. A silver halide imaging element according to claim 1 including a blue exposure recording layer unit containing a first subtractive primary dye image-forming coupler and silver halide grains in a dispersing medium, a green exposure recording layer unit containing a second subtractive primary dye image-forming coupler and silver halide grains in a dispersing medium, and a red exposure recording layer unit containing a third subtractive primary dye image-forming coupler and silver halide grains in a dispersing medium, the couplers being chosen to form a dye of a different subtractive primary hue in each of the layer units, and the dispersing medium in at least one emulsion layer of at least one of the layer units being comprised of an organic vehicle and, dispersed therein, titanium dioxide particles having an average size of less than 0.1 micrometer accounting for at least 40 percent by weight of the dispersing medium.

11. A silver halide imaging element capable of providing sharp dye images when scanned with silver halide grains still present following imagewise exposure and development comprised of a transparent film support and, coated on the support, a blue exposure recording layer unit containing a first subtractive primary dye image-forming coupler and blue sensitized silver halide grains dispersed in an organic vehicle, a green exposure recording layer unit containing a second subtractive primary dye image-forming coupler and green sensitized silver halide grains dispersed in an organic vehicle, and a red exposure recording layer unit containing a third subtractive primary dye image-forming coupler and red sensitized silver halide grains dispersed in an organic vehicle, the couplers being chosen to form a dye of a different subtractive primary hue in each of the layer units,

WHEREIN the organic vehicle containing the silver halide grains additionally contains dispersed therein titanium dioxide particles having an average size of less than 0.07 micrometer accounting for from 50 to 90 percent of the weight of the organic vehicle and titanium dioxide particles.

12. A method of obtaining and utilizing an image comprising (1) imagewise exposing an element according to claim 1, (2) developing the silver halide grains as a function of imagewise exposure to produce a visible image, (3) without removing silver halide remaining after step (2) from the element, using the visible image to modulate light directed to the emulsion layer, and (4) recording the image pattern of light passing through the emulsion layer.

13. A method according to claim 12 wherein the visible image is a silver image.

14. A method according to claim 12 wherein the image pattern of light passing through the emulsion layer is recorded in a second silver halide imaging element.

15. A method according to claim 12 wherein the image pattern of light passing through the element is retrieved by a photosensor and digitally stored.

16. A method of obtaining and utilizing a multicolor image comprising (1) imagewise exposing a multicolor dye image forming element comprised of a transparent film support and, coated on the support, a blue exposure recording layer unit containing a first subtractive primary dye image-forming coupler and blue sensitized silver halide grains dispersed in an organic vehicle, a green exposure recording layer unit containing a second subtractive primary dye image-forming coupler and green sensitized silver halide grains dispersed in an organic vehicle, and a red exposure recording layer unit containing a third subtractive primary dye image-forming coupler and red sensitized silver halide grains dispersed in an organic vehicle, the couplers being chosen to form a dye of a different subtractive primary hue in each of the layer units, and the organic vehicle containing the silver halide grains additionally containing dispersed therein titanium dioxide particles having an average size of less than 0.07 micrometer accounting for from 50 to 90 percent of the weight of the organic vehicle and titanium dioxide particles, (2) developing the silver halide grains as a function of imagewise exposure with a color developing agent to produce a dye image of a different subtractive primary hue in each of the emulsion layer units, (3) reconverting developed silver to silver halide by bleaching, (4) without removing silver halide from the element, passing light through the layer units and film support as a function of dye absorption, and (5) recording the light passing through the element to capture images corresponding to the pattern of blue, green and red exposure absorptions within the element.

17. A method of obtaining and utilizing a multicolor image comprising (1) imagewise exposing a multicolor dye image forming element comprised of a white, reflective support and, coated on the support, a blue exposure recording layer unit containing a first subtractive primary dye image-forming coupler and blue sensitized silver halide grains dispersed in an organic vehicle, a green exposure recording layer unit containing a second subtractive primary dye image-forming coupler and green sensitized silver halide grains dispersed in an organic vehicle, and a red exposure recording layer unit containing a third subtractive primary dye image-forming coupler and red sensitized silver halide grains dispersed in an organic vehicle, the couplers being chosen to form a dye of a different subtractive primary hue in each of the layer units, and the organic vehicle containing the silver halide grains additionally containing dispersed therein titanium dioxide particles having an average size of less than 0.07 micrometer accounting for from 50 to 90 percent of the weight of the organic vehicle and titanium dioxide particles, (2) developing the silver halide grains as a function of imagewise exposure with a color developing agent to produce a dye image of a different subtractive primary hue in each of the emulsion layer units, (3) reconverting developed silver to silver halide by bleaching, (4) without removing silver halide from the element, passing light through the layer units as a function of dye absorption, and (5) recording the specular light reflected from the element to capture images corresponding to the pattern of blue, green and red exposure absorptions within the element.

* * * * *